US007810633B2

(12) United States Patent
Okamoto et al.

(10) Patent No.: US 7,810,633 B2
(45) Date of Patent: Oct. 12, 2010

(54) BELT MEANDERING CORRECTION APPARATUS AND IMAGE FORMING APPARATUS EMPLOYING THE SAME

(75) Inventors: Masaya Okamoto, Saitama (JP); Yasuhiro Warita, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 71 days.

(21) Appl. No.: 12/337,195

(22) Filed: Dec. 17, 2008

(65) Prior Publication Data

US 2009/0294256 A1 Dec. 3, 2009

(30) Foreign Application Priority Data

May 28, 2008 (JP) ..... P2008-139526

(51) Int. Cl.
*G03G 15/20* (2006.01)

(52) U.S. Cl. ..... 198/806; 399/165; 399/329

(58) Field of Classification Search ..... 198/806, 198/807; 399/165, 329
See application file for complete search history.

(56) References Cited

U.S. PATENT DOCUMENTS

| | | | | | |
|---|---|---|---|---|---|
| 2,655,252 | A * | 10/1953 | Spurgeon | 198/806 |
| 3,993,186 | A * | 11/1976 | Sokolowski | 198/806 |
| 5,471,289 | A * | 11/1995 | Satoh et al. | 399/328 |
| 6,125,994 | A * | 10/2000 | Todome | 198/806 |
| 6,173,930 | B1 * | 1/2001 | Arbucci | 248/208 |
| 6,405,854 | B1 * | 6/2002 | Cumberlege | 198/806 |
| 7,058,345 | B2 * | 6/2006 | Abe et al. | 399/303 |
| 7,565,095 | B2 * | 7/2009 | Mori | 399/165 |
| 2007/0272512 | A1 | 11/2007 | Maki | 198/339.1 |

FOREIGN PATENT DOCUMENTS

| | | |
|---|---|---|
| JP | 05-346746 | 12/1993 |
| JP | 2001-080782 | 3/2001 |
| JP | 2005-343577 | 12/2005 |
| JP | 2007-47702 A | 2/2007 |
| JP | 2008-29096 A | 2/2008 |
| JP | 2009-186910 A | 8/2009 |

* cited by examiner

*Primary Examiner*—Mark A Deuble
(74) *Attorney, Agent, or Firm*—Morgan, Lewis & Bockius LLP

(57) ABSTRACT

A belt meandering correction apparatus is provided and includes: belt extending rolls that extend an endless-shaped belt member, including a belt meandering correction roll, at least one end part of which is supported in a manner movable in a direction defined by joining a revolving shaft center of the correction roll to a point of contact with the belt member so that meandering of the belt member is corrected; a revolving body which is arranged at least at the one end part of the correction roll in a manner movable along an axial direction of the correction roll and which has a surface abutting against an end part of the belt member and an inclined surface whose outer diameter varies along the axial direction; and a fixed member arranged at a fixed position such as to abut against an outer peripheral surface of the revolving body.

9 Claims, 17 Drawing Sheets

60 DEGREES

30 DEGREES

BELT MEANDERING CORRECTION APPARATUS AND IMAGE FORMING APPARATUS EMPLOYING THE SAME

CROSS-REFERENCE TO RELATED APPLICATION

This application is based on and claims priority under 35 USC §119 from Japanese Patent Application No. 2008-139526 filed May 28, 2008.

BACKGROUND (i) Technical Field

The present invention relates to a belt meandering correction apparatus and an image forming apparatus employing the same.

(ii) Related Art

In the related art, in some of image forming apparatuses like those described above, a plurality of image forming sections for forming toner images of mutually different colors are arranged in parallel to each other, and then the toner images of mutually different colors formed by the plurality of image forming sections are transferred an stacked directly onto a recording paper sheet conveyed in a state of being attracted to a paper conveyance belt extended around a plurality of rolls. Alternatively, the toner images are primary-transferred and stacked onto an intermediate transfer belt extended around a plurality of rolls, and then secondary-transferred collectively onto a recording paper sheet. As a result, an image of full color or the like is formed.

Further, in some of the above-mentioned image forming apparatuses, in a fixing unit for fixing a not-yet-fixed toner image transferred on a recording paper sheet, a fixing belt extended around a plurality of rolls heats and pressurizes the recording paper sheet on which a not-yet-fixed toner image is transferred, so that fixing processing is achieved.

As such, in some of the above-mentioned image forming apparatuses, in performing image formation operation, belt driving apparatuses are widely employed for driving the circulation of an endless-shaped belt member such as a paper conveyance belt, an intermediate transfer belt, a heating belt, and a pressurizing belt extended around a plurality of rolls.

Meanwhile, in the above-mentioned belt driving apparatuses, the endless-shaped belt member is extended around a plurality of rolls, and then the endless-shaped belt member is revolved by the drive roll so that the circulation movement of the endless-shaped belt member is achieved.

Thus, in the above-mentioned belt driving apparatuses, as known widely, a positional error and an insufficient component precision in the rolls for extending the endless-shaped belt member as well as variation or the like in the belt extending force and the driving force for the endless-shaped belt member cause a so-called meandering phenomena that the circulating drive is performed in a state that the endless-shaped belt member is deviated toward one end part in an axial direction of a roll. Then, the meandering phenomena in the endless-shaped belt member causes positional deviation in the recording paper conveyed by the paper conveyance belt, the toner image primary-transferred on the intermediate transfer belt, or the recording paper that undergoes fixing processing by the heating belt and the pressurizing belt. This causes color image deviation, image deviation, and poor fixing.

SUMMARY (1) A Belt Meandering Correction Apparatus Comprising:

a plurality of belt extending rolls that extend an endless-shaped belt member, wherein at least one of the plurality of belt extending rolls is a belt meandering correction roll, and at least one end part of the belt meandering roll is supported in a manner movable in a direction defined by joining a center of a revolving shaft of the belt meandering correction roll to a point of contact with the endless-shaped belt member extended around the plurality of belt extending rolls so that meandering of the endless-shaped belt member is corrected;

a revolving body that is arranged at least at the one end part of the belt meandering correction roll in a manner movable along an axial direction of the belt meandering correction roll and that has a surface abutting against an end part of the endless-shaped belt member and an inclined surface whose outer diameter varies along the axial direction of the belt meandering correction roll; and a fixed member arranged at a fixed position such as to abut against an outer peripheral surface of the revolving body.

BRIEF DESCRIPTION OF THE DRAWINGS

Embodiments of the present invention will be described in detail based on the following figures, wherein.

DETAILED DESCRIPTION

Exemplary embodiments of the invention are described below with reference to the drawings.

Embodiment 1

Figure 2:
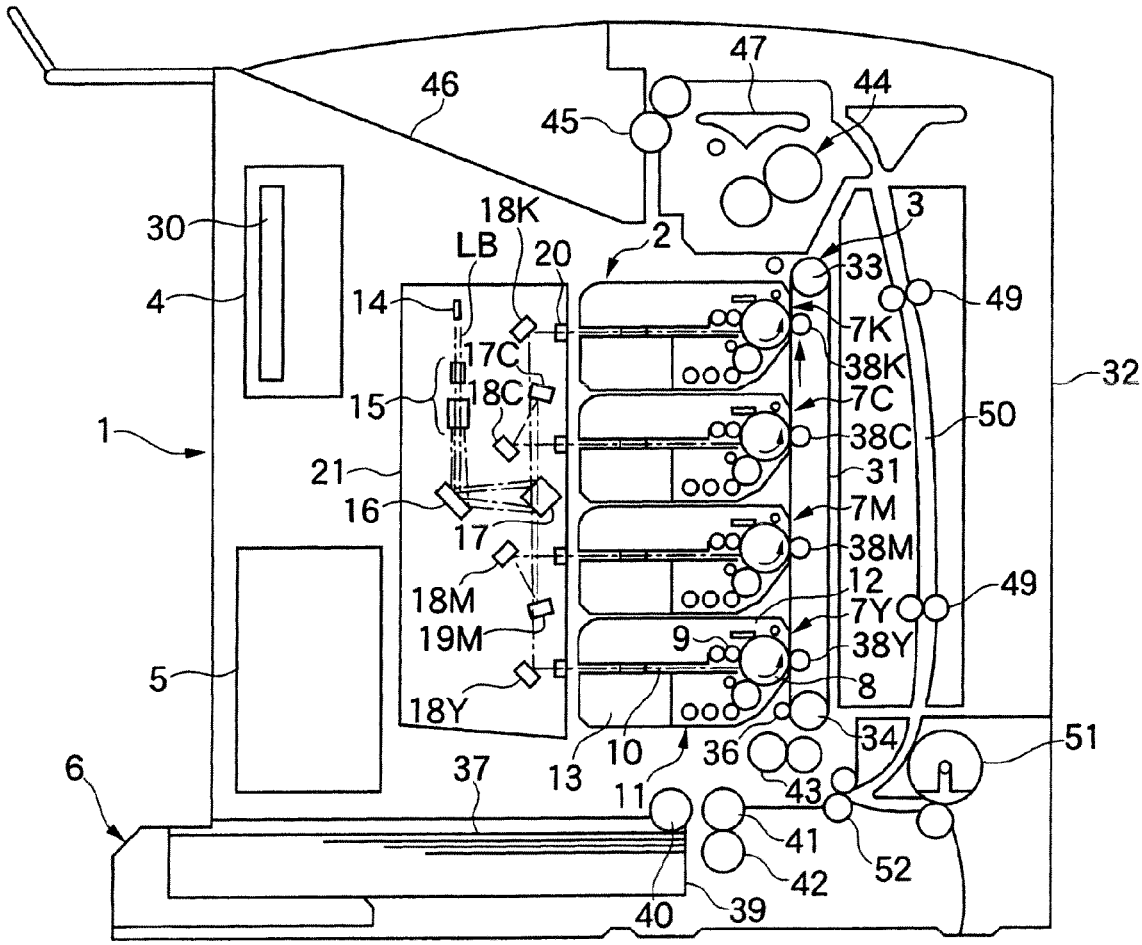
FIG. 2 is a diagram showing a tandem type full color printer serving as an image forming apparatus in which a belt meandering correction apparatus according to Embodiment 1 of the invention is applied.

FIG. 2 shows a tandem type full color printer serving as an image forming apparatus in which a belt meandering correction apparatus according to Embodiment 1 of the invention is applied.

In FIG. 2, numeral 1 indicates the main body of a tandem type full color printer serving as an image forming device main body. In the inside of the printer main body 1, an image forming unit 2 is arranged in an approximately center part up and down in the vertical direction. Further, in the inside of the full color printer main body 1, a paper conveyance belt unit 3 that attracts and conveys a recording medium onto which toner images of plural colors formed by the image forming unit 2 is to be transferred is arranged on one side (the right-hand side, in this example) of the image forming unit 2. On the other side (the left-hand side, in this example) of the image forming unit 2, a control unit 4 provided with a control circuit and the like is arranged. Further, obliquely under the image forming unit 2, a power circuit unit 5 provided with a high voltage power supply circuit and the like is arranged. Furthermore, in a bottom part inside the full color printer main body 1, a sheet feeding unit 6 for feeding a recording paper sheet 37 and the like serving as a recording medium is arranged.

The image forming unit 2 has four process cartridges 7Y, 7M, 7C, and 7K for forming toner images of individual colors consisting of yellow (Y), magenta (M), cyan (C), and black (K) in order from the bottom. These tour process cartridges 7Y, 7M, 7C, and 7K are arranged in parallel to each other with fixed intervals in the vertical direction.

The four process cartridges 7Y, 7M, 7C, and 7K are constructed similarly to each other except for the color of an image to be formed. Schematically, as shown in FIG. 2, each process cartridge comprises: a photosensitive drum 8 serving as an image carrier driven and revolved at a predetermined revolving speed along an arrow direction; an electrostatic charging roll 9 for primary electrostatic charging that charges uniformly the surface of the photosensitive drum 8; an image exposure path 10 where image exposure corresponding to the individual colors is performed on the surface of the photosensitive drum 8 by an image exposure unit 21 so that electrostatic latent images are formed; a developing unit 11 serving as a developing unit for developing with toners of corresponding colors the electrostatic latent images formed on the photosensitive drum 8; and a cleaning unit 12 for cleaning un-transferred residual toner that remains on the photosensitive drum 8.

As shown in FIG. 2, the image exposure unit 21 is common to the four process cartridges 7Y, 7M, 7C, and 7K for yellow (Y), magenta (M), cyan (C), and black (K). Then, the image exposure unit 21 comprises: four semiconductor lasers 14 for emitting laser beams LB on the basis of image data of individual colors consisting of yellow (Y), magenta (M), cyan (C), and black (K); a collimator lens 15 for converting into parallel light beams the four laser beams LB emitted from the four semiconductor lasers 14; a reflection mirror 16 for reflecting the laser beams LB emitted from the semiconductor lasers 14; a revolving polygon mirror 17 for deflecting the laser beams LB reflected by the reflection mirror 16 so as to perform scan; a plurality of reflection mirrors 18 and 19 for performing scanning exposure onto the photosensitive drums 8 of the individual image forming sections 7Y, 7M, 7C, and 7K with the laser beams LB reflected by the revolving polygon mirror 17; and a transmitting glass plate 20 for transmitting the laser beams LB. Here, the reflection mirrors 18 and 19 have the function of changing the focal length (f) in accordance with the deflecting angle (θ) of the laser beam LB.

On the other hand, in the inside of the full color printer main body 1, as shown in FIG. 2, the control unit 4 is arranged. In the control unit 4, for example, an image processing apparatus 30 for performing predetermined image processing onto image data is arranged. From the image processing apparatus 30, image data of individual colors consisting of yellow (Y), magenta (A), cyan (C), and black (K) is outputted sequentially to the image exposure unit 10. Then, the four laser beams LB emitted from the image exposure unit 10 in accordance with the image data are scanned on the individual photosensitive drums 8Y, 8M, 8C, and 8K so that exposure is performed and electrostatic latent images are formed. Then, the electrostatic latent images formed on the individual photosensitive drums 8Y, 8M, 8C, and 8K are developed by the developing units 11Y, 11M, 11C, and 11K into toner images of individual colors consisting of yellow (Y), magenta (M), cyan (C), and black (K).

Further, as shown in FIG. 2, the paper conveyance belt unit 3 has the paper conveyance belt 31 serving as an endless-shaped belt member that has no break and performs circulation movement. The paper conveyance belt 31 electrostatically attracts and conveys a recording paper sheet 37 serving as a recording medium onto which toner images of individual colors yellow (Y), magenta (M), cyan (C), and black (K) formed by the four process cartridges 7Y, 7M, 7C, and 7K are to be transferred. Further, the paper conveyance belt unit 3 is constructed in the form of a unit integrated with conveyance rolls 49 provided in a recording paper conveyance path 50 for inversion. In a case that jam or the like occurs in the recording paper sheet 37, when a front cover 32 provided in the front face of the printer main body 1 in a freely opened and closed manner is opened, the unit moves to a retreating position of being rotated in a clockwise direction relative to the printer main body 1.

As shown in FIG. 2, the paper conveyance belt 31 is extended with a predetermined tension around a drive roll 33 and a follower roll 34 serving as a plurality of belt extending rolls arranged up and down in the vertical direction. Then, the paper conveyance belt 31 performs circulation movement in a clockwise direction at a predetermined rate by means of the drive roll 33 driven and revolved by a drive motor (not shown) or the like via gear wheels and the like. The distance between the drive roll 33 and the follower roll 34 is set approximately equal to the length of the recording paper sheet 37, for example, of A3 size. However, the present invention is not limited to this, and the distance between the drive roll 33 and the follower roll 34 may be set up arbitrarily. The paper conveyance belt 31 is constructed, for example, when a synthetic resin film such as polyimide and polyimidoamide that has flexibility but has a lower extensibleness than a rubber material is formed into the shape of an endless belt.

Further, as shown in FIG. 2, an attracting roll 36 for electrostatically attracting the recording paper sheet 37 onto the surface of the paper conveyance belt 31 is arranged such as to abut against the surface of the follower roll 34 via the paper conveyance belt 31. Similarly to the electrostatic charging rolls 9 of the process cartridges 7Y, 7M, 7C, and 7K, the attracting roll 36 is constructed, for example, by covering the surface of a metal core with electrically conductive rubber. Then, a predetermined bias voltage for attraction is applied onto the metal core. Then, the attracting roll 36 electrostatically charges the transfer paper sheet 37 sent from the sheet feeding unit 6 such that the transfer paper sheet 37 should be attracted onto the surface of the paper conveyance belt 31.

The toner images of individual colors consisting of yellow (Y), magenta (M), cyan (C), and black (K) formed on the photosensitive drums 8Y, 8M, 8C, and 8K of the process cartridges 7Y, 7M, 7C, and 7K are, as shown in FIG. 2, transferred and stacked by the transfer rollers 38Y, 38M, 38C, and 38K onto the recording paper sheet 37 conveyed in a state of being attracted to the surface of the paper conveyance belt 31. Here, the transfer rollers 38Y, 38M, 38C, and 38K are integrally attached on the paper conveyance belt unit 3 side.

As shown in FIG. 2, the recording paper sheet 37 is fed from the sheet feeding unit 6 arranged in a bottom part of the printer main body 1. The sheet feeding unit 6 has a sheet tray 39 for accommodating recording paper sheets 37 of desired size and construction material. From the sheet tray 39, a recording paper sheet 37 of desired size and construction material is fed by a feeding roll 40. At that time, a supply roll 41 and a separation roll 42 ensure the separation into each sheet. Then, the sheet is conveyed to an attracting position on the paper conveyance belt 31 via a resist roll 43 at a predetermined timing.

Here, the recording paper sheet 37 may be a sheet-shaped member of a diverse size such as A4 size, A3 size, B5 size, and B4 size and a diverse construction material such as ordinary paper, cardboard paper such as coated paper, and an OHP sheet.

Then, the recording paper sheet 37 on which the toner images of individual colors consisting of yellow (Y), magenta (M), cyan (C), and black (K) have been transferred and stacked is, as shown in FIG. 2, separated from the paper conveyance belt 31 by means of the own rigidity (or stiffness) of the recording paper 37, and then conveyed to a fixing unit 44. Then, the toner images of individual colors are fixed onto the recording paper sheet 37 by the heat and pressure of the fixing unit 44. The paper conveyance belt 31 and the fixing unit 44 are arranged close to each other. Thus, the recording paper sheet 37 separated from the fixing unit 44 is conveyed to the fixing unit 44 by the carrying force of the paper conveyance belt 31. After that, the recording paper sheet 37 on which the toner images of individual colors have been fixed is ejected by an ejection roll 45 onto an ejection tray 46 provided in an upper part of the full color printer main body 1 in a state that the print face is turned down. Then, the printing operation is completed.

Here, in the above-mentioned full color printer, in place of a full color image, an image of desired color such as monochrome can be printed. Thus, in accordance with the image color to be printed, a toner image or toner images are formed by all or a part of the process car ridges 7Y, 7M, 7C, and 7K for yellow (Y) magenta (M), cyan (C) and black (K).

Further, when an image is to be formed in each of the two faces of the recording paper sheet 37 by the above-mentioned full color printer, the recording paper sheet 37 in which an image on one side has been fixed by the fixing unit 44 is not directly ejected onto the erection tray 46 by the ejection roll 45. Instead, in a state that the back end part of the recording paper sheet 37 is held by the ejection roll 45, the ejection roll 45 is reversed. Further, a switching gate 47 switches the conveyance path for the recording paper sheet 37 into the upper path, so as to convey the recording paper sheet 37 to the recording paper conveyance path 50 for inversion where the conveyance rolls 49 are provided along the one side surface of the printer main body 1. Then, the recording paper sheet 37 conveyed into the recording paper conveyance path 50 for inversion is conveyed again to the attracting position of the paper conveyance belt 31 by the resist roll 43 in a state that the front and the back are reversed. Then, after the toner images are transferred onto the rear face, fixing processing is performed by the heat and pressure by the fixing unit 44. Then, the recording paper sheet 37 is ejected by the ejection roll 45 onto the ejection tray 46 provided in an upper part of the printer main body 1.

Here, in FIG. 2, numeral 51 indicates a sheet feeding roll for feeding a transfer material of desired size and construction material from a manual feeding tray (not shown) provided in a side surface of the printer main body 1. Numeral 52 indicates a conveyance roll for conveying to the resist roll 43 a recording medium fed by the sheet feeding roll 51.

Meanwhile, in the present embodiment, the configuration comprises:

a plurality of belt extending rolls for extending an endless-shaped belt member;

a belt meandering correction roll which is at least one belt extending roll among the plurality of belt extending rolls and at least one end part of which is supported in a manner movable in a direction defined by joining a revolving shaft center of the belt extending roll to a point of contact with the belt meandering correction roll extended around the belt meandering correction roll so that meandering of the endless-shaped belt member is corrected;

a revolving body that is arranged at least at the one end part of the belt meandering correction roll in a manner movable along an axial direction of the belt meandering correction roll and that has a surface abutting against an end part of the endless-shaped belt member and an, inclined surface whose outer diameter varies along the axial direction of the belt meandering correction roll; and a fixed member arranged at a fixed position such as to abut against the outer peripheral surface of the revolving body.

Figure 3:
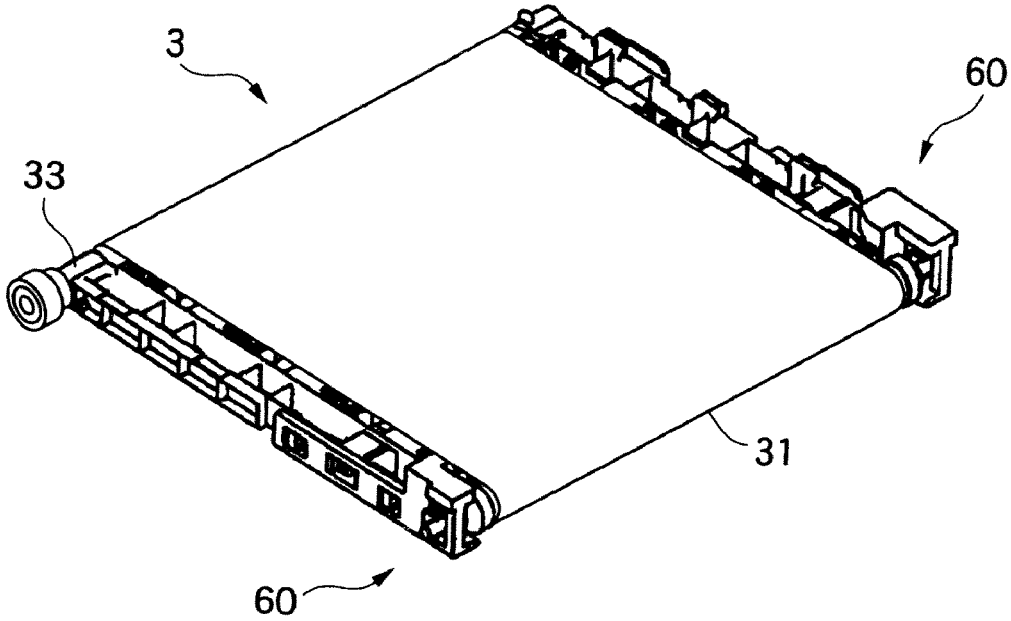
FIG. 3 is a perspective configuration diagram showing a belt meandering correction apparatus according to Embodiment 1 of the invention.

That is, as shown in FIG. 3, the belt meandering correction apparatus 60 according to the present embodiment is installed in the paper conveyance belt unit 3. Schematically, the paper conveyance belt unit 3 comprises: a paper conveyance belt 31; a drive roll and a follower roll serving as a plurality of belt extending rolls for extending the paper conveyance belt 31; and a belt unit 61 in which the drive roll and the follower roll are installed.

Figure 4:
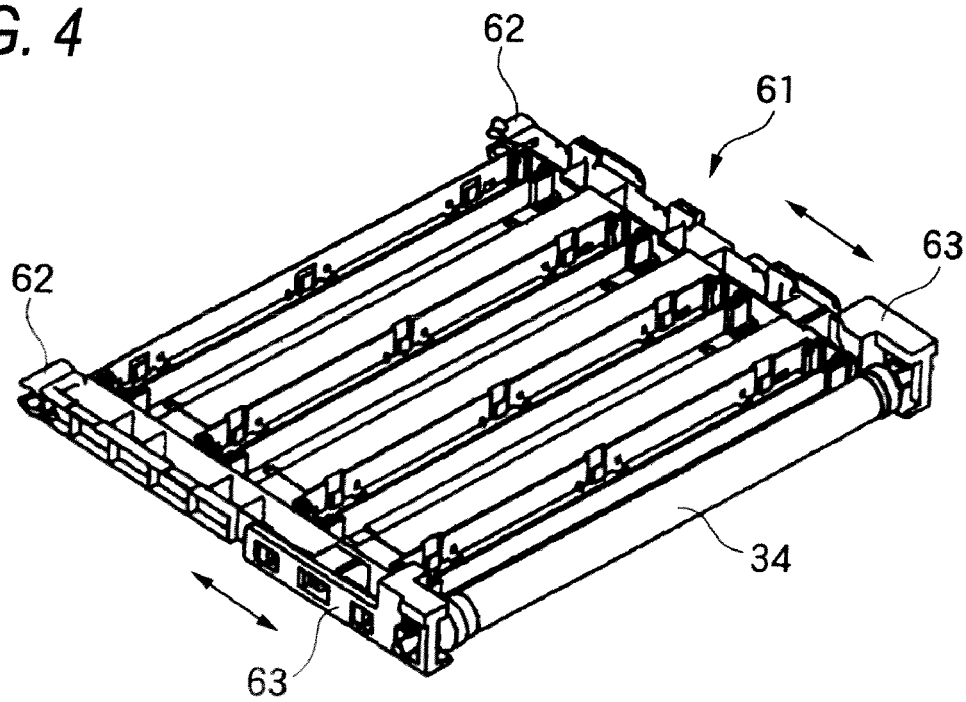
FIG. 4 is a perspective configuration diagram showing a belt meandering correction apparatus according to Embodiment 1 of the invention, in a state that a belt is removed.
Figure 5A:
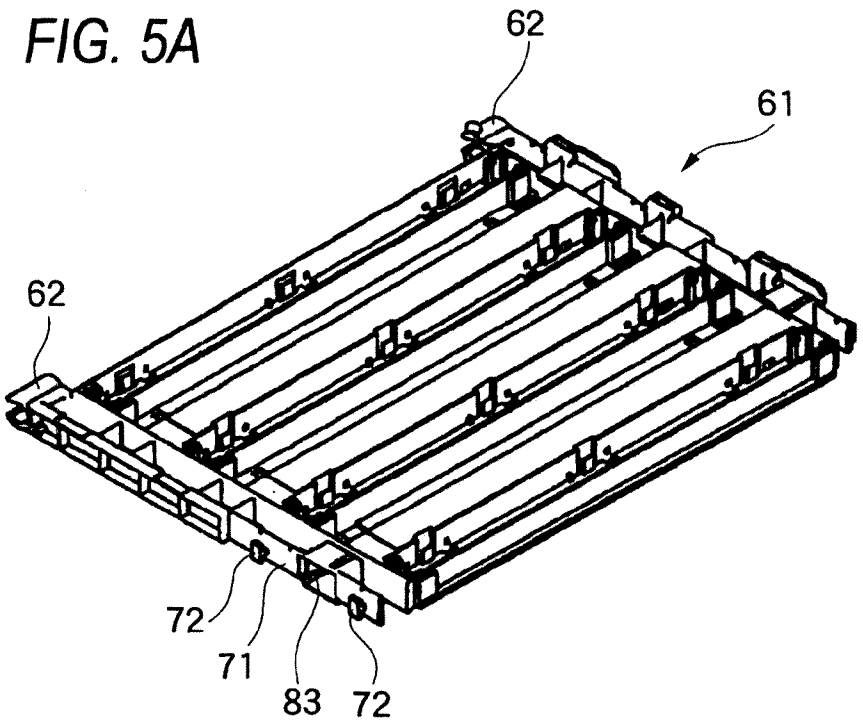
FIGS. 5A to 5D are diagrams showing a perspective configuration diagram, a plan view, a front view, and a side view of a belt unit of a belt meandering correction apparatus according to Embodiment 1 of the invention.
Figure 5D:
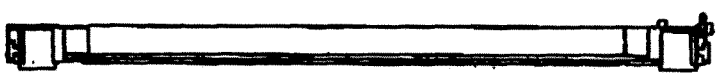
Figure 5B:
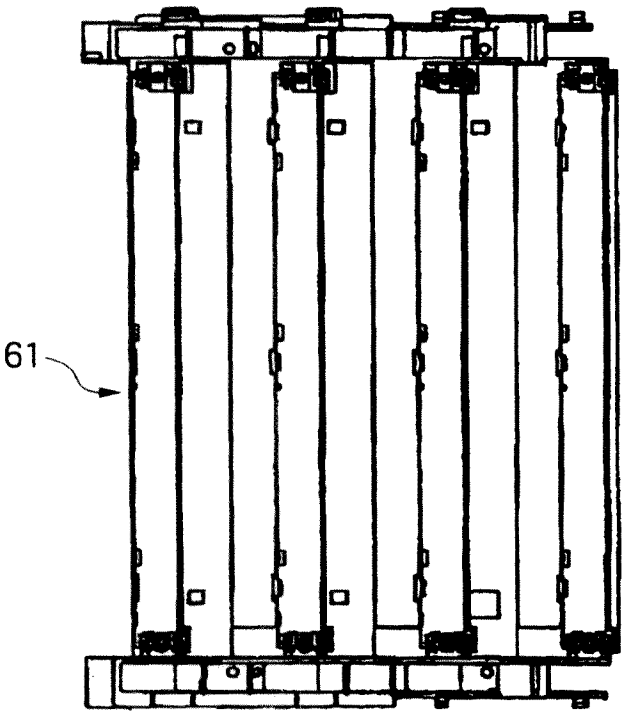
Figure 5C:
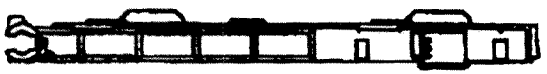

As shown in FIGS. 4 and 5, the belt unit 61 is formed in the shape of a planar rectangular frame having a relatively small thickness. In one end part of the belt unit 61, a bearing section 62 is provided for attaching the drive roll 33 in a revolvable manner. In the other end part, as shown in FIG. 4, the follower roll 34 is installed via a holding member 63 in a manner slidable in the directions approaching and departing relative to the drive roll 33. Further, in the belt unit 61, transfer rolls 38Y, 38M, 38C, and 38K (not shown) are arranged in a revolvable manner and in a manner that a predetermined transfer bias can be applied.

Figure 7:
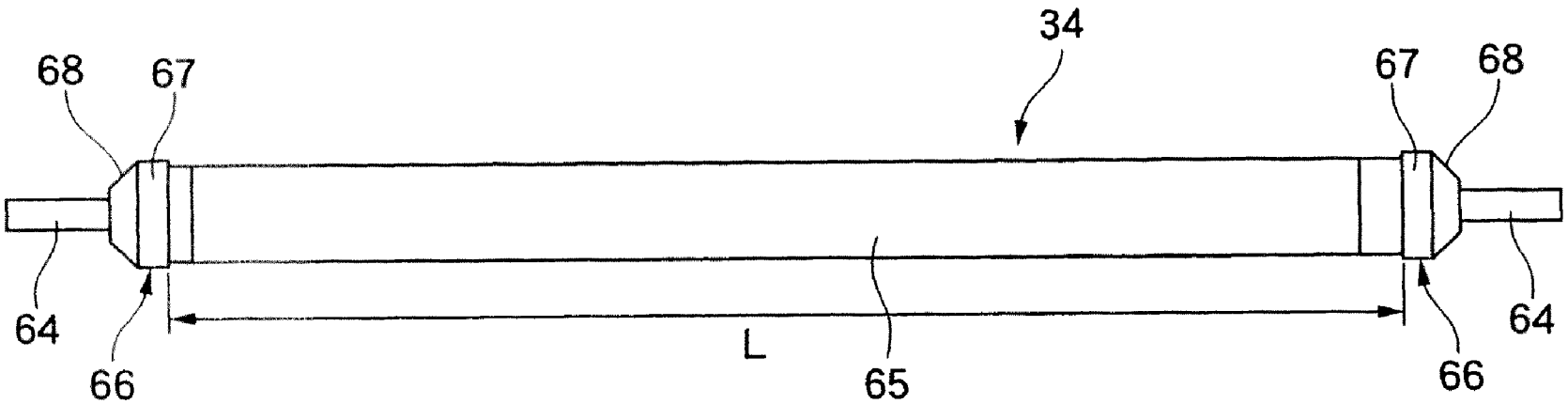
FIG. 7 is a diagram showing a front view of a belt meandering correction roll.
Figure 8A:
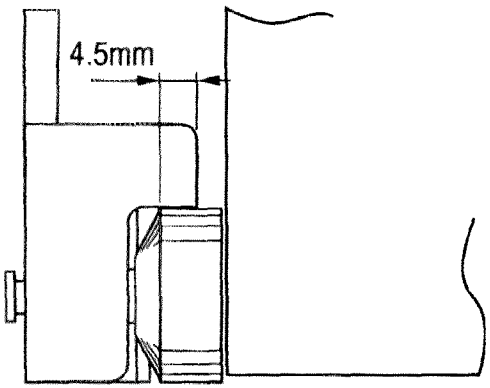
FIGS. 8A to 8D are main part configuration diagrams showing various modes of a belt meandering correction roll.
Figure 8C:
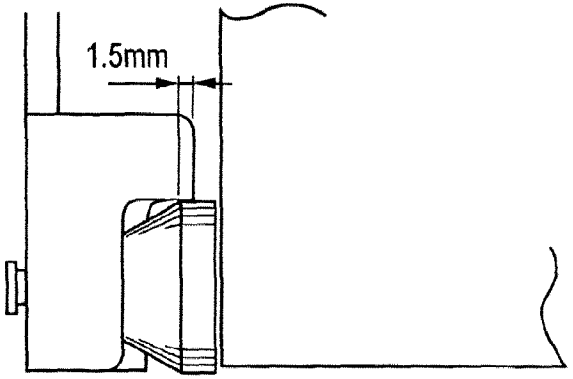
Figure 8B:
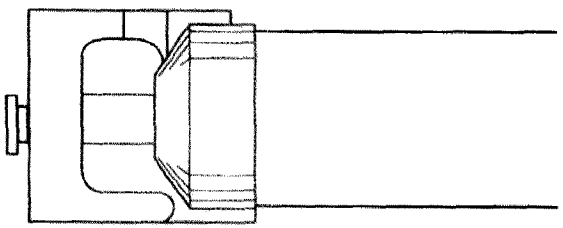
Figure 8D:
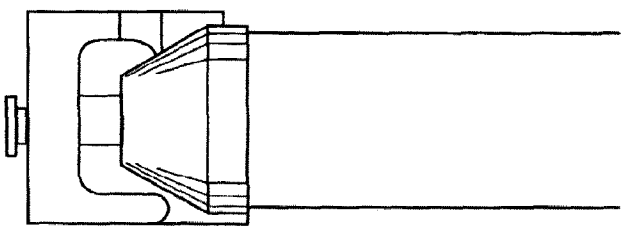

Further, as shown in FIG. 7, a belt meandering correction roll 34 constructed from the follower roll is held by a revolving shaft 64 in a revolvable manner and constructed from: a belt extending section 65 having a cylindrical shape for extending the paper conveyance belt 31, and revolving bodies 66 arranged in the two end parts of the belt extending section 65 in an integrated or separated manner. Further, the revolving body 66 is attached in a manner integrated with or separated from the belt extending section 65 having a cylindrical shape in a slidable manner along the axial direction of the revolving shaft 64. Here, in the present embodiment, the revolving body 66 is constructed as the belt meandering correction roll 34 in a manner integrated with the belt extending section 65.

As shown in FIG. 7, in the revolving body 66, a flange part 67 is provided that abuts against an end face of the paper conveyance belt 31. The distance L between the end faces of the flange parts 67 of the right and left revolving bodies 66 is set wider than the width of the paper conveyance belt 31. Thus, the paper conveyance belt extended around the drive roll 33 and the belt meandering correction roll 34 performs circulation movement normally in a state that the end faces do not contact with the flange parts 67 of the revolving bodies 66.

Further, as shown in FIG. 7, in the revolving body 66, in an axial outside portion of each flange part 67, an inclined surface 68 having a conical shape is provided whose outer diameter varies with a fixed rate along the axial direction of the belt meandering correction roll 34. The inclined surface 68 is formed, for example, with an inclination of 45 degrees relative to the revolving shaft 64 of the belt meandering correction roll 34. However, the angle of the inclined surface 68 is not limited to 45 degrees. That is, as shown in FIG. 8, the angle of inclination may be another value such as 60 degrees and 30 degrees.

Figure 9:
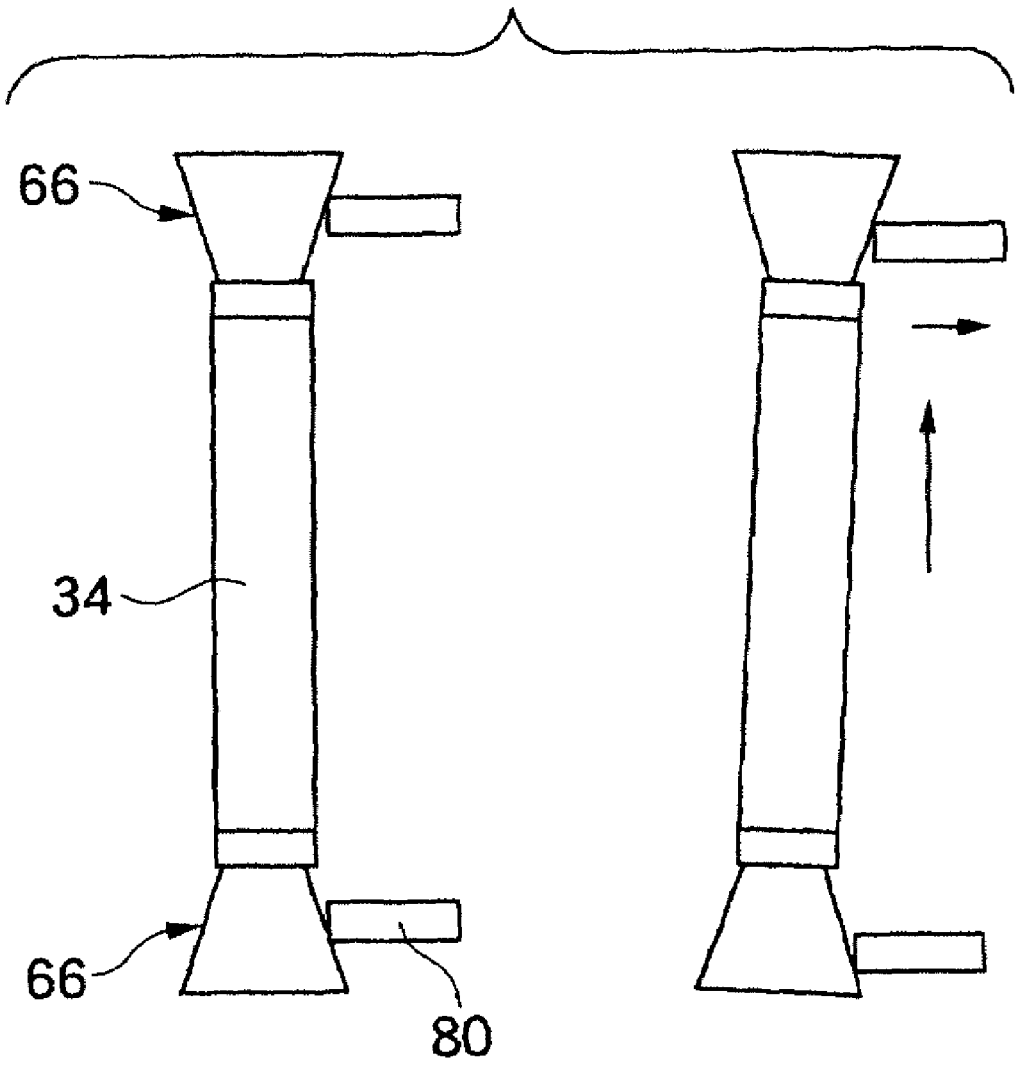
FIG. 9 is a schematic configuration diagram showing a modification of a belt meandering correction apparatus according to Embodiment 1 of the invention.

Further, in this embodiment shown in the figure, the outer diameter is reduced gradually toward the axial outside part of the belt meandering correction roll 34. Instead, as shown in FIG. 9, the outer diameter may be reduced gradually toward the axial inward direction.

Figure 6A:
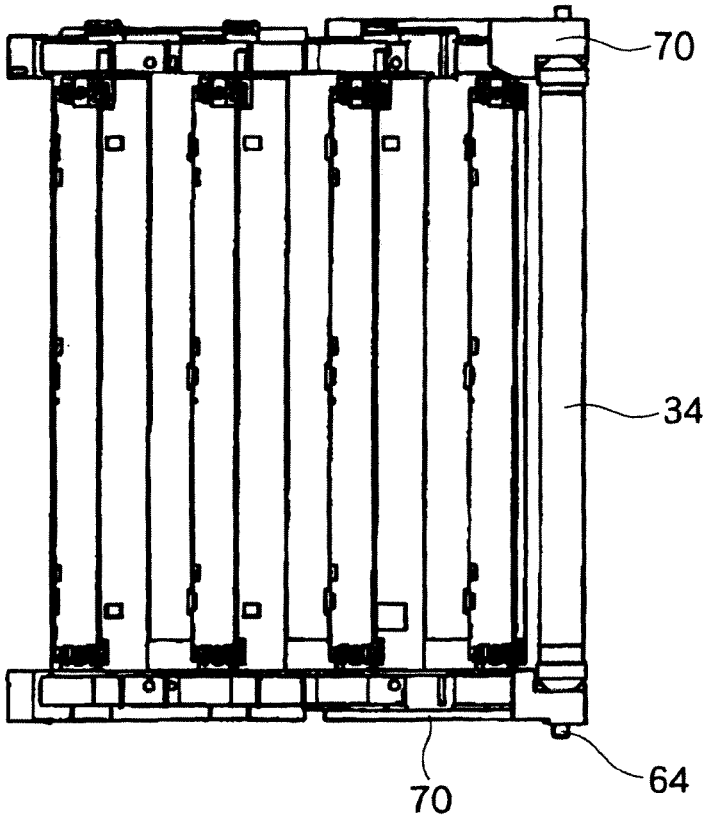
FIGS. 6A to 6C are diagrams showing a plan view, a front view, and a side view of a belt meandering correction apparatus according to Embodiment 1 of the invention, in a state that rollers are attached to a belt unit.
Figure 6B:
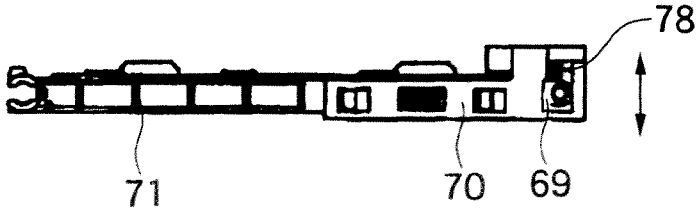
Figure 6C:
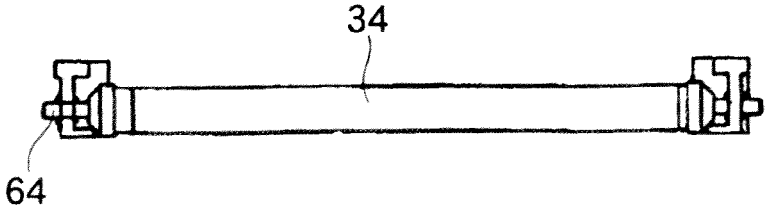

Further, as shown in FIG. 6, the revolving shaft 64 of the belt meandering correction roll 34 is held in a revolvable manner by holding members 70 via bearing members 69. The bearing members 69 are attached in a manner movable in a direction obtained by joining the revolving shaft center of the belt meandering correction roll 34 to the point of contact with the paper conveyance belt 31 extended around the belt meandering correction roll 34, more specifically, in a direction perpendicular to the running direction of the paper conveyance belt 31.

Figures 10A, 10B, 10C, 10D, 10E:
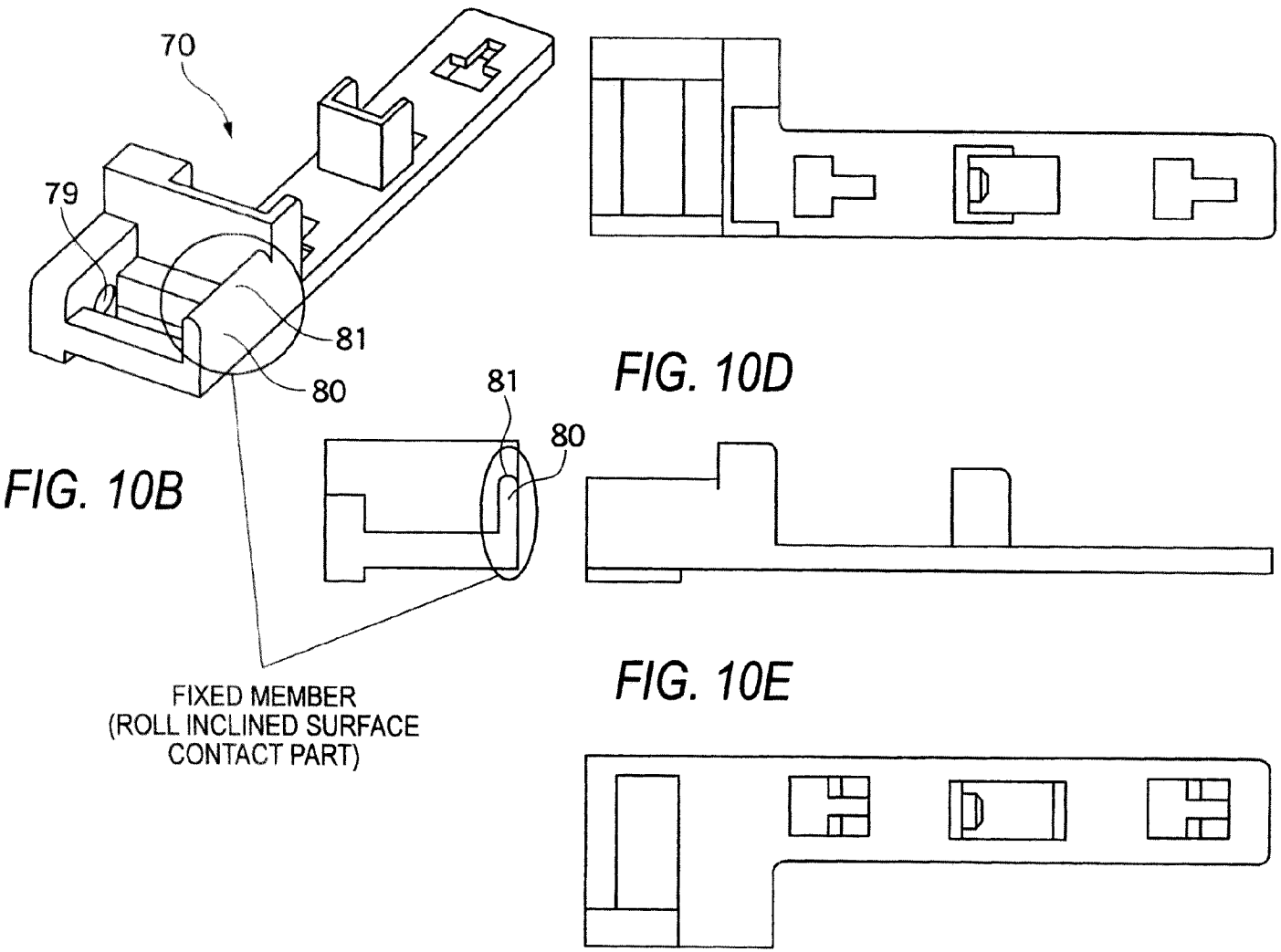
FIGS. 10A to 10E are diagrams showing a perspective view, a side view, a plan view, a front view, and a bottom view of one holding member.
Figure 11A:
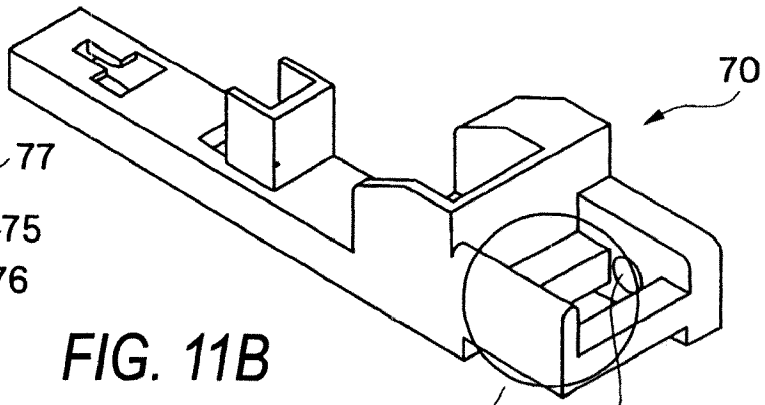
FIGS. 11A to 11E are diagrams showing a perspective view, a side view, a plan view, a front view, and a bottom view of the other holding member.
Figure 11B:
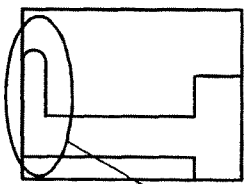
Figure 11C:
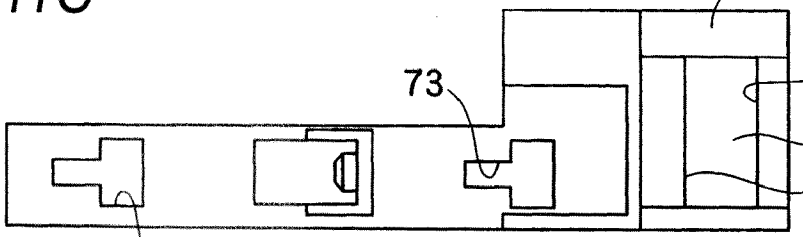
Figure 11D:
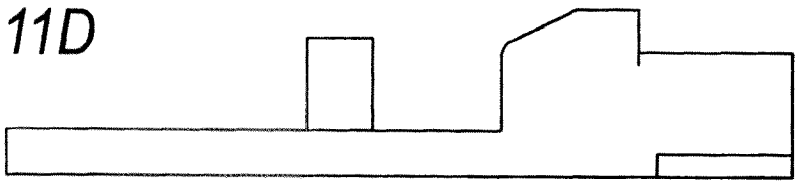
Figure 11E:
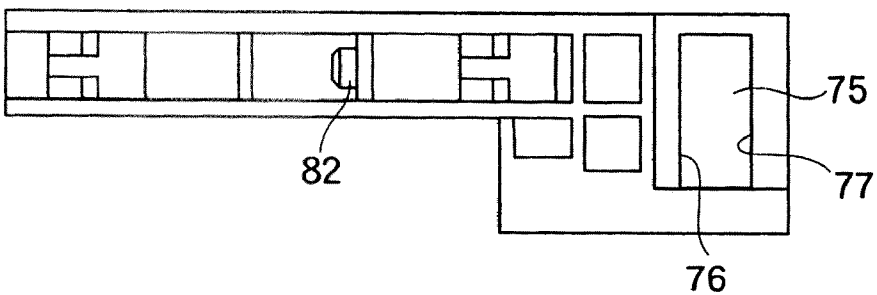

As shown in FIGS. 10 and 11, the holding members 70 are in a right and left symmetric shape. Their front shape is an elonoated rectangle. As shown in FIG. 5, in the longitudinal direction of the holding member 70, a T-shaped elongated hole 73 is drilled that engages relatively with a protrusion 72 provided in a side surface of the frame 71 of the belt unit 61 so that the holdlng member 70 is attached in a manner slidable along the running direction of the belt. Further, in one end part of the holding member 70 in the longitudinal direction, a holding member 74 for holding the revolving shaft 64 of the belt meandering correction roll 34 in a revolvable manner is formed in the shape of an approximate square having a height greater than the other portions. In the holding section 74, an opening 75 having a rectangular shape is provided into which the bearing member 69 for holding the revolving shaft 64 of the belt meandering correction roll 34 in a revolvable manner is fit in a manner movable in the up and down directions in FIG. 6.

Figure 12:
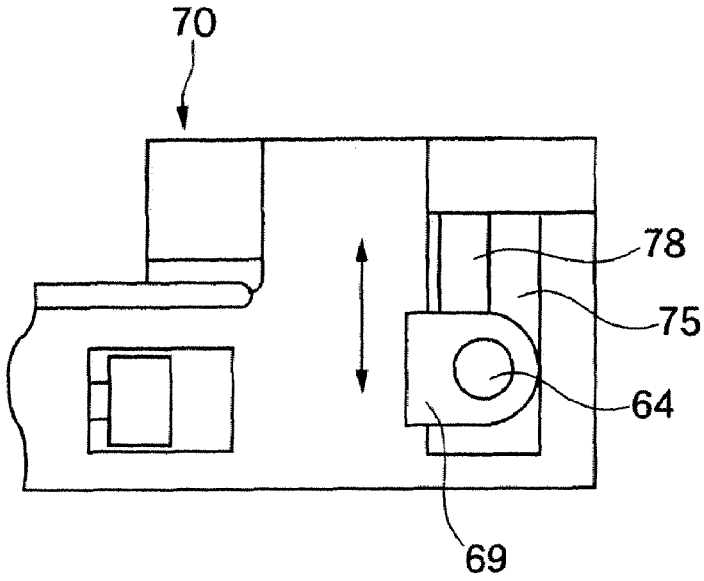
FIG. 12 is a diagram showing a side view of a main part of a holding member.

In one side surface of the opening 75 having a rectangular shape, as shown in FIG. 11, a guide part 76 is provided into which the bearing member 69 is fit in a manner movable in the up and down directions (the direction defined by joining the revolving shaft center of the belt meandering correction roll 34 to the point of contact with the belt 31 extended around the belt meandering correction roll 34). Further, as shown in FIG. 12, the other side surface 77 of the opening 75 having a rectangular shape is constructed such that the revolving shaft 64 of the belt meandering correction roll 34 can revolve even when contacting directly. Here, similarly to the one side surface 76, the other side surface 77 of the opening 75 having a rectangular shape may also be constructed such that the bearing member 69 may be fit in a manner movable in the up and down directions. Further, in the top surface of the opening 75 having a rectangular shape, as shown in FIGS. 10 and 11, a fitting hole 79 is drilled into which a spring 78 for biasing the bearing member 69 downward is fit.

Further, in the holding member 70, as shown in FIGS. 10 and 11, in the lower end face of the opening 75, a fixed member 80 that abuts against the inclined surface 68 of the revolving body described above is provided integrally toward the axial inward direction of the revolving shaft 64 of the belt meandering correction roll 34. In the fixed member 80, a surface 81 that abuts against the inclined surface 68 of the revolving body 66 is formed in an arc shape. This shape reduces a sliding resistance generated relative to the inclined surface 68 of the revolving body 66.

Here, in the holding member 70, as shown in FIGS. 10 and 11, the belt meandering correction roll 34 is biased in a direction imparting a tension to the paper conveyance belt 31 by a compression spring (not shown) installed between a protrusion 82 and a recess 83 shown in FIG. 5.

Figure 13:
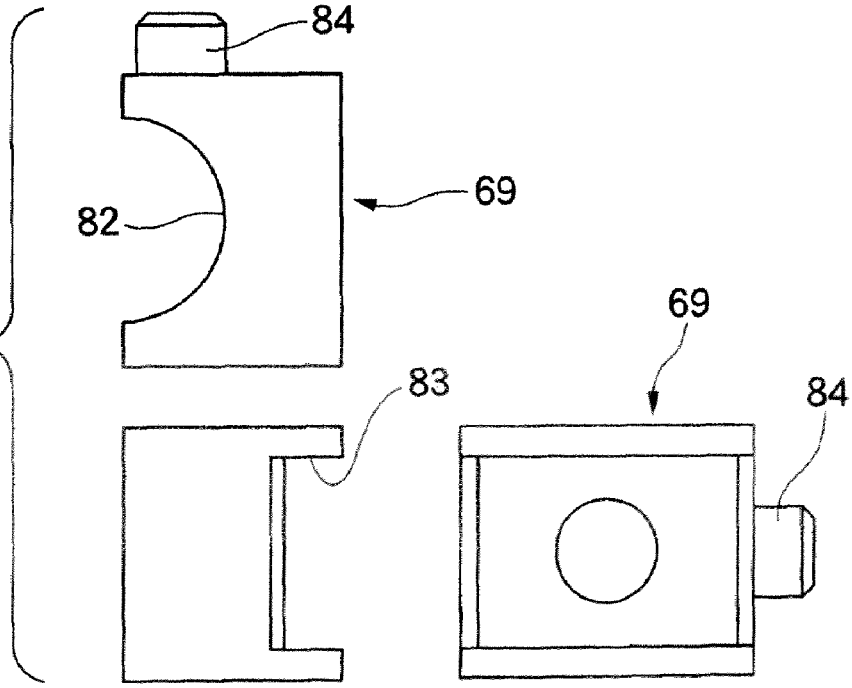
FIG. 13 is a diagram showing a bearing member.

On the other hand, in the bearing member 69, as shown in FIG. 13, in one side surface, a bearing part 82 for holding the revolving shaft 64 of the belt meandering correction roll 34 in a revolvable manner is provided in the form of a semicircular recess. In the side surface opposite to the bearing part 82 of the bearing member 69, a planar approximately C-shaped recess 83 is provided into which the bearing member 69 is fit in a manner slidable relative to the holding member 70. Further, in the upper end face of the bearing member 69, as shown in FIG. 13, a cylindrical protrusion 84 for suspending the biasing spring 78 is provided between this protrusion 84 and the top surface of the opening 75 of the holding member 70.

Then, in the belt meandering correction roll 34, as shown in FIG. 13, the revolving shaft 64 is supported in a revolvable manner by the bearing member 69. The bearing member 69 is biased by the spring 78 in a direction abutting against the lower end face of the opening 75 of the holding member 70. Further, as shown in FIG. 3, the belt meandering correction roll 34 is constructed such that in a state that the revolving shaft 64 is located in parallel to the revolving shaft of the drive roll 33, the recording paper holding belt 31 performs circulation movement.

In this configuration, in the full color printer according to the present embodiment, as described below, a belt meandering correction apparatus can be provided in which in contrast to the case of employing a belt displacement support unit including a linkage mechanism or the like, size increase and cost increase are not caused in the apparatus and in which in contrast to a case that a belt tension is changed by displacement of a tension roller for imparting a predetermined tension to a belt, overload that could be caused by fluctuation in the belt tension is avoided onto the belt and construction material for the belt is not limited to a highly extensible one. Further, an image forming apparatus employing the same can be provided.

That is, in the full color printer according to this embodiment, as shown in FIG. 2, image exposure in accordance with the image data of individual colors is performed by the image exposure unit 21 onto the photosensitive drums 8Y, 8M, 8C, and 8K of the process cartridges 7Y, 7M, 7C, and 7K for yellow (Y), magenta (M), cyan (C), and black (K), so that electrostatic latent images corresponding to the image data of individual colors consisting of yellow (Y), magenta (M), cyan (C), and black (K) are formed on the surface of the photosensitive drums 8Y, 8M, 8C, and 8K. Then, the electrostatic latent images formed on the surface of the photosensitive drums 8Y, 8M, 8C, and 8K are developed by the developing units 11Y, 11M, 11C, and 11K, so that toner images of the corresponding colors are formed.

The toner images of individual colors consisting of yellow (Y), magenta (M), cyan (C), and black (K) formed on the photosensitive drums 8Y, 8M, 8C, and 8K are sequentially transferred and stacked onto the recording paper sheet 37 held on the paper conveyance belt 31, then fixed by the fixing unit 44, and then ejected onto the ejection tray 46 provided in an upper part of the printer main body 1.

Meanwhile, in the full color printer, as shown in FIG. 2, at the time of conveyance of the recording paper sheet 37 in a state of being attracted onto the surface of the paper conveyance belt 31, when meandering is caused in the paper conveyance belt 31 by various factors, the transfer positions deviate in the toner images formed by the process cartridges 7Y, 7M, 7C, and 7K for yellow (Y), magenta (M), cyan (C), and black (K). Thus, color image deviation and image deviation occur, and hence cause image quality defects.

Figure 1A:
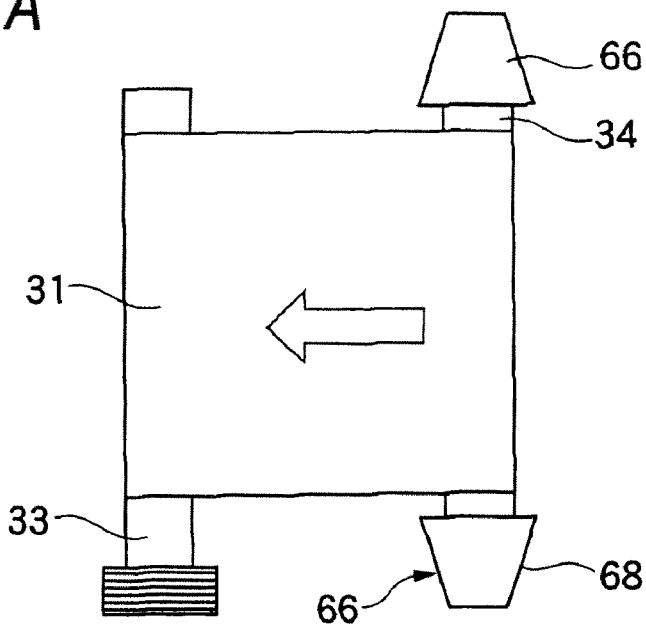
FIGS. 1A and 1B are schematic configuration diagrams showing a belt meandering correction apparatus according to Embodiment 1 of the invention.
Figure 1B:
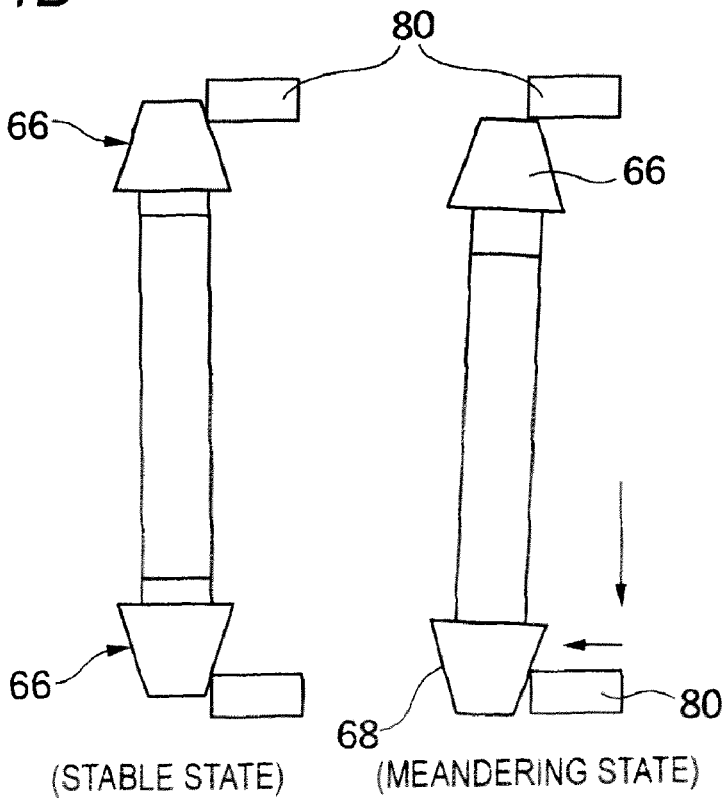
Figure 14:
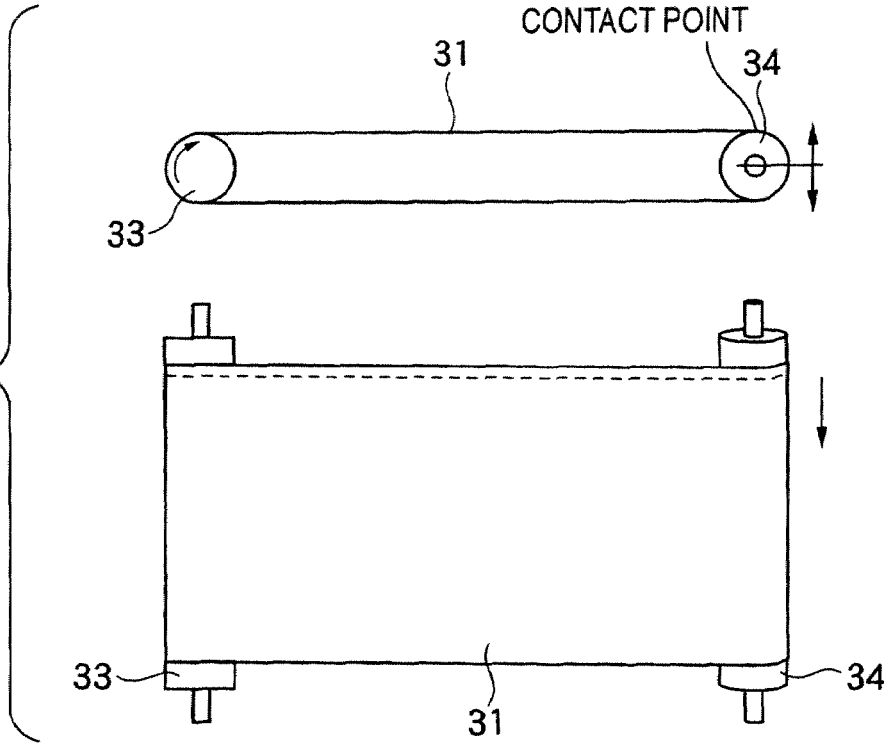
FIG. 14 is an explanation diagram showing a belt meandering correction situation in a belt meandering correction apparatus according to Embodiment 1 of the invention.

Thus, in the present embodiment, as shown in FIG. 1, when meandering occurs in the paper conveyance belt 31, an end part of the paper conveyance belt 31 abuts against the flange part 67 of the revolving body 66 provided in an end part of the belt meandering correction roll 34. Then, when the amount of meandering in the paper conveyance belt 31 reaches or exceeds a predetermined value where image quality is affected, the revolving body 66 is pressed in an axial direction of the belt meandering correction roll 34, so that the revolving body 66 moves in the axial outward direction of the belt meandering correction roll 34. Then, in the revolving body 66, the inclined surface 67 abuts against the fixed member 80 provided in the holding member 70. When the amount of meandering increases in the paper conveyance belt 31, the inclined surface 68 of the revolving body 66 is lifted upward in FIG. 3 by an increasing amount by the fixed member 80. Thus, the one end part moves from the state that the revolving shaft 64 of the belt meandering correction roll 34 is in a horizontal position to a direction, as shown in FIG. 14, defined by joining the revolving shaft center of the belt meandering correction roll 34 to the point of contact with the paper conveyance belt 31 extended around the belt meandering correction roll 34. Thus, in the paper conveyance belt 31 that performs circulation movement in a state of being wound around the belt meandering correction roll 34, the position of winding around the outer periphery of the belt meandering correction roll 34 is displaced in the direction opposite to the meandering direction of the belt 31 as shown in FIG. 14, so that the meandering of the paper conveyance belt 31 is corrected automatically.

Then, when the meandering of the paper conveyance belt 31 has been corrected so that the end part of the paper conveyance belt 31 no longer abuts against the flange part 67 of the revolving body 66, the force of pressing the revolving body 66 outward in the axial direction no longer acts. Thus, the revolving body 66 receives a force acting on the inclined surface 68 in the axial inward direction of the revolving shaft 64, and hence the meandering of the paper conveyance belt 31 is resolved.

Here, even when meandering of the paper conveyance belt 31 occurs in a direction toward the other end part, similar operation is achieved.

Further, basically, the revolving bodies 66 are provided in the two end parts along the axial direction of the belt meandering correction roll 34. However, the revolving body 66 may be provided only in one end along the axial direction of the belt meandering correction roll 34 so that even when the meandering is resolved in a middle position of the inclined surface 68 of the revolving body 66 and it moves in an upward or downward direction of the inclined surface 68, the middle position of the inclined surface 68 of the revolving body 66 may stably abut against the fixed member 80. Even in this case that the revolving body 66 is provided only in one end along the axial direction of the belt meandering correction roll 34, the present invention can be implemented.

Further, the inclined surface 68 of the revolving body 66 is set into an inclination angle of, for example, 45 degrees. However, the present invention is not limited to this. That is, as shown in FIG. 8, another angle such as 60 degrees and 30 degrees may be adopted.

At that time, when a larger inclination angle is adopted in the inclined surface 68 of the revolving body 66, the force increases that is generated when meandering occurs in the paper conveyance belt 31 and that moves the revolving body 66 in the direction of correcting the meandering of the paper conveyance belt 31. Thus, meandering of the paper conveyance belt 31 can be corrected in a shorter time. Nevertheless, the increase in the force for moving the revolving body 66 in the correction direction could cause instability in the operation. This could result in a situation that the belt meandering correction roll 34 moves frequently in the axial directions.

Further, in a case that a smaller inclination angle of the inclined surface 68 of the revolving body 66 is adopted, when meandering occurs in the paper conveyance belt 31, the force decreases that moves the revolving body 66 in the direction of correcting the meandering of the paper conveyance belt 31. This could increase the necessary time for correcting the meandering of the paper conveyance belt 31. However, this small force for moving the revolving body 66 in the correction direction could stabilize the operation.

Figure 15:
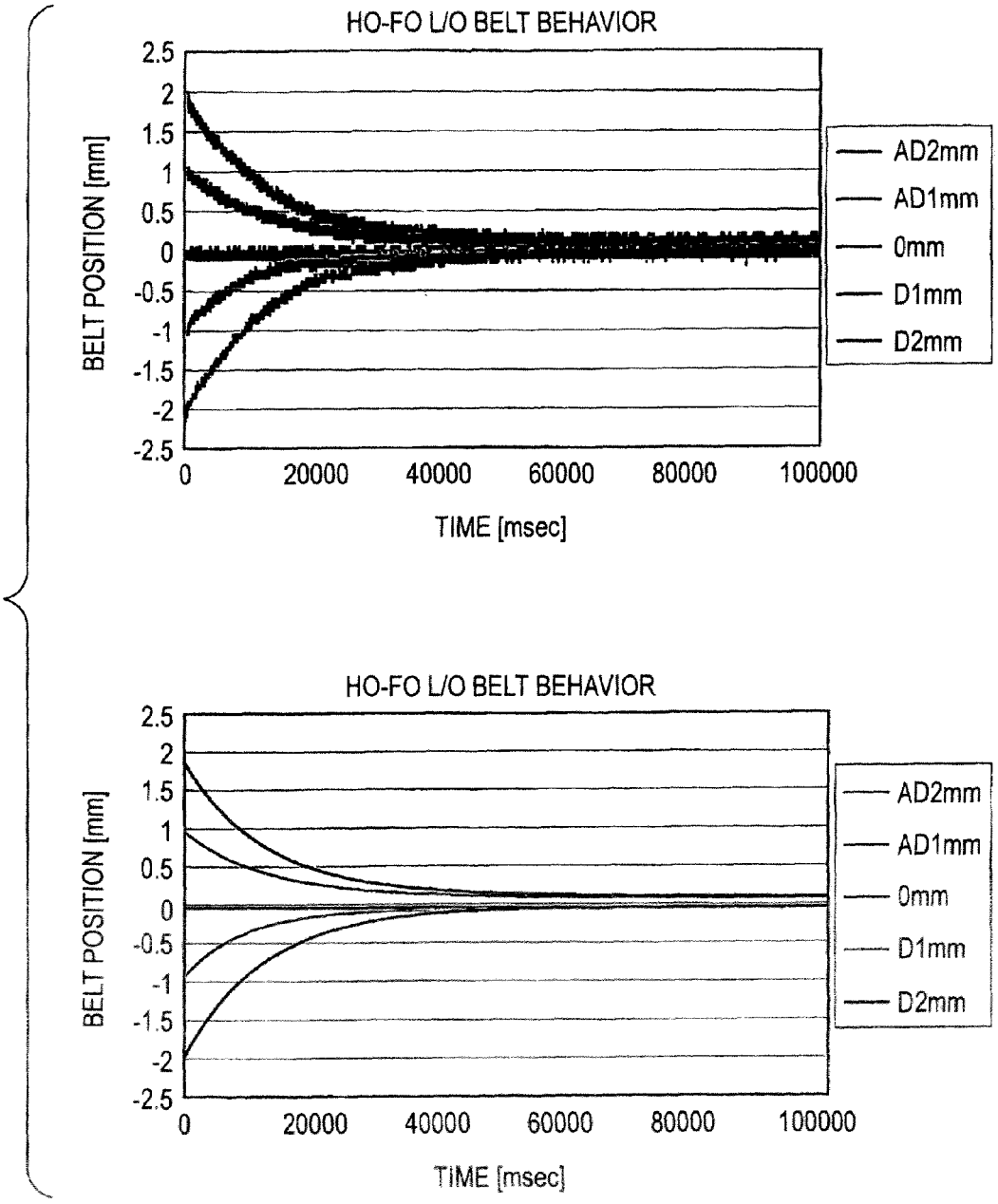
FIG. 15 is graphs showing a result of measurement of a situation that meandering of a paper conveyance belt is corrected.
Figure 16:
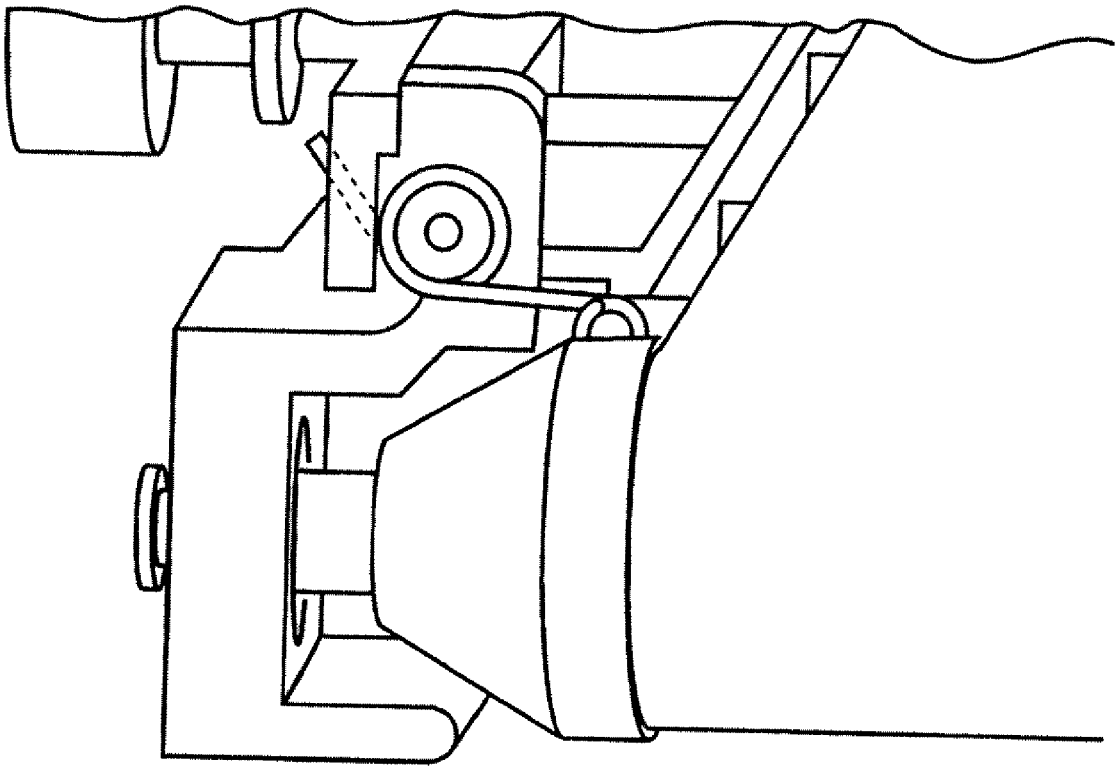
FIG. 16 is an explanation diagram showing a belt meandering correction situation in a belt meandering correction apparatus according to Embodiment 1 of the invention.

FIG. 15 is a graph showing a result of measurement of a situation that meandering of the paper conveyance belt 31 is corrected. This shows that even when meandering of approximately 2 mm occurs in the paper conveyance belt 31, the amount of meandering can be corrected into approximately 0 (zero) by means of idling revolution of approximately 20 to 40 sec.

Embodiment 2

FIG. 1 shows Embodiment 2 of the invention. Like parts to those of the above-mentioned embodiment are designated by like reference numerals. The present Embodiment 2, a holding structure for the belt meandering correction roll is different from that of Embodiment 1 given above.

Figure 17:
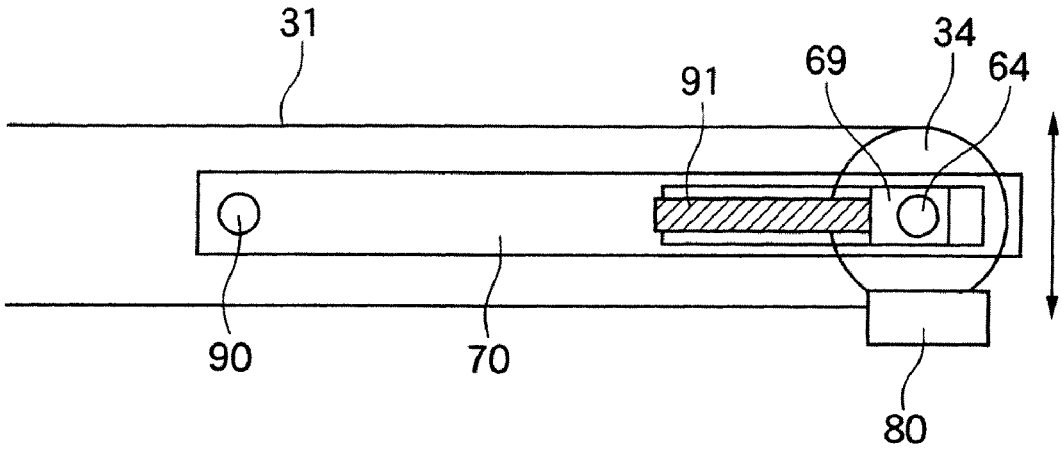
FIG. 17 is a configuration diagram showing a main part of a belt meandering correction apparatus according to Embodiment 2 of the invention.

That is, in the present Embodiment 2, as shown in FIG. 17, the holding member 70 for holding the belt meandering correction roll 34 in a revolvable manner is not attached to the frame 71 in a linearly slidable manner. Instead, the holding member 70 is supported around a fulcrum 90 relative to the frame 71 in a manner movable in a direction defined by joining the revolving shaft center of the belt meandering correction roll 34 to the point of contact with the endless-shaped belt member extended around the belt extending rolls.

Further, in the holding member, a bearing member for supporting the belt meandering correction roll in a revolvable manner is held in a manner movable in the directions approaching and departing relative to the drive roll. Further, the bearing member 69 is biased in the direction departing from the drive roll 33 by a pressurizing unit 91 including a coil spring or the like. Here, the pressurizing unit 91 is employed for imparting a predetermined tension to the paper conveyance belt 31, and applies a tension of approximately 2.5 to 3 kgf.

Figure 18:
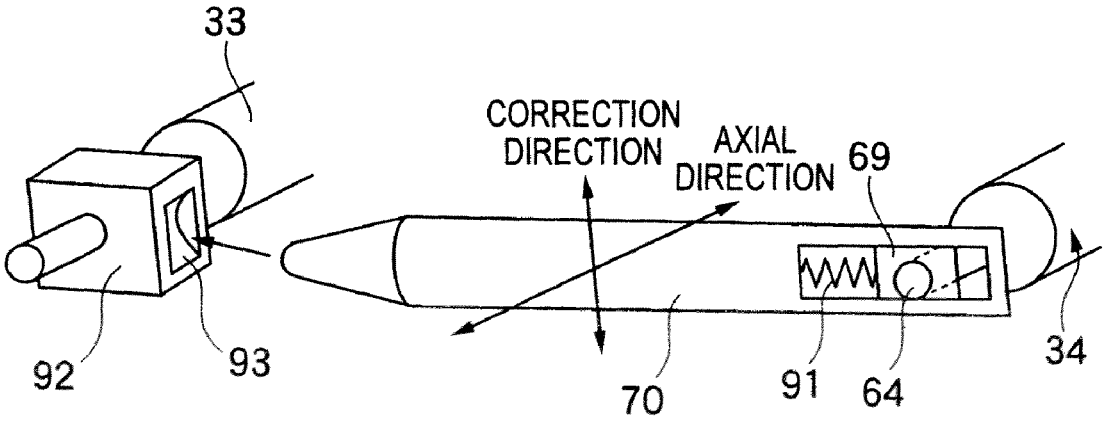
FIG. 18 is a perspective main part configuration diagram showing a modification of a belt meandering correction apparatus according to Embodiment 2 of the invention.

Further, in a modification of the present Embodiment 2, as shown in FIG. 18, the holding member 70 is constructed from a long bar-shaped member. Then, one end part of the bar member 70 is movable around a fulcrum including a recess 93 of a holding member 92 on the drive roll 33 side in two directions consisting of: the direction defined by joining the revolving shaft center of the belt meandering correction roll 34 to the point of contact with endless-shaped belt member 51 extended around the belt meandering correction roll 34; and the axial direction of belt extending roll 51.

The other points in the configuration and the operation are similar to those of Embodiment 1 given above. Thus, their description is omitted.

Embodiment 3

Figure 19A:
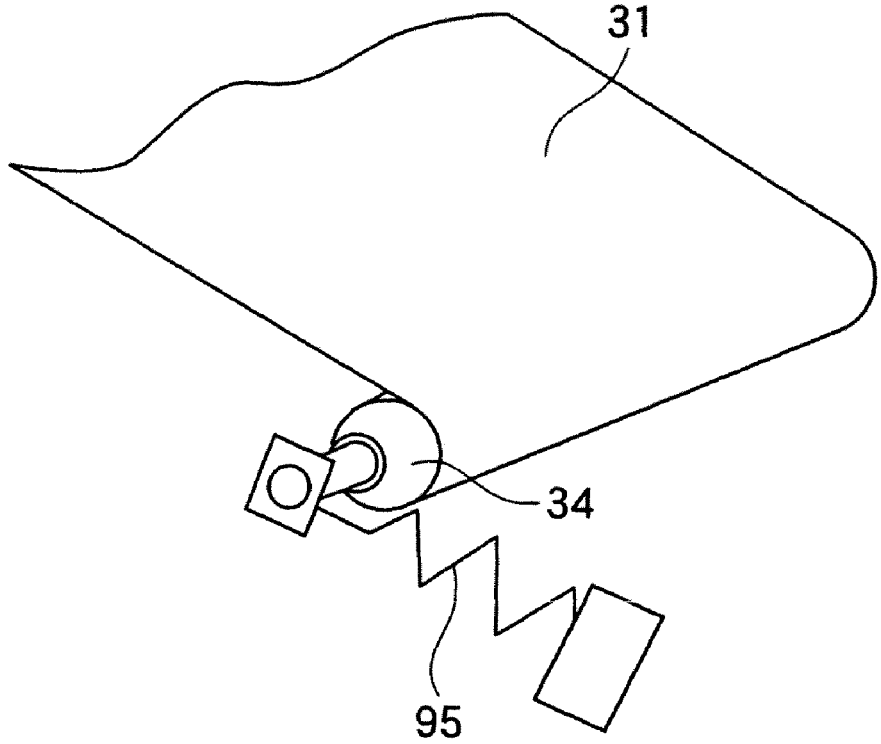
FIGS. 19A and 19B are configuration diagrams showing a main part of a belt meandering correction apparatus according to Embodiment 3 of the invention.
Figure 19B:
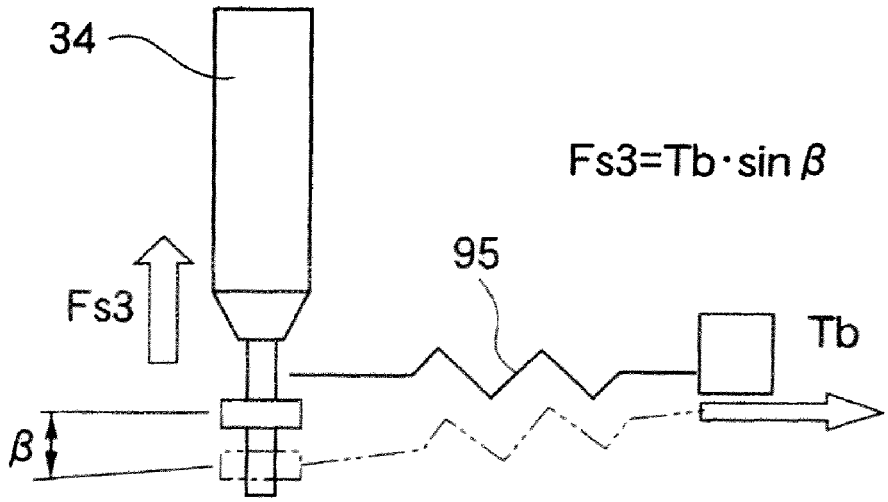

FIG. 19 shows Embodiment 3 of the invention. Like parts to those of the above-mentioned embodiment are designated by like reference numerals. In the present Embodiment 3, a holding structure for the belt meandering correction roll is different from that of Embodiment 1 given above.

That is, in the present Embodiment 3, as shown in FIG. 19, the holding member 70 for holding the belt meandering correction roll 34 in a revolvable manner is biased in the direction opposite to the drive roll 33 by a biasing unit 95 including a tension spring or the like, so that the biasing unit 95 biases it in the direction departing from the drive roll 33. Further, when the belt meandering correction roll 34 moves along an axial direction, a force Fs3 generated by the biasing unit 95 toward the axial inward direction of the belt meandering correction roll 34 causes a force in the direction of correcting the meandering of the belt meandering correction roll 34.

Further details are described below. In the present Embodiment 3, as shown in FIG. 20, in an exemplary case that an intermediate transfer belt 100 is employed as an endless-shaped belt member in place of the paper conveyance belt, the intermediate transfer belt 100 is extended over a long running area by a plurality of belt extending rolls 101 to 103.

Figure 20:
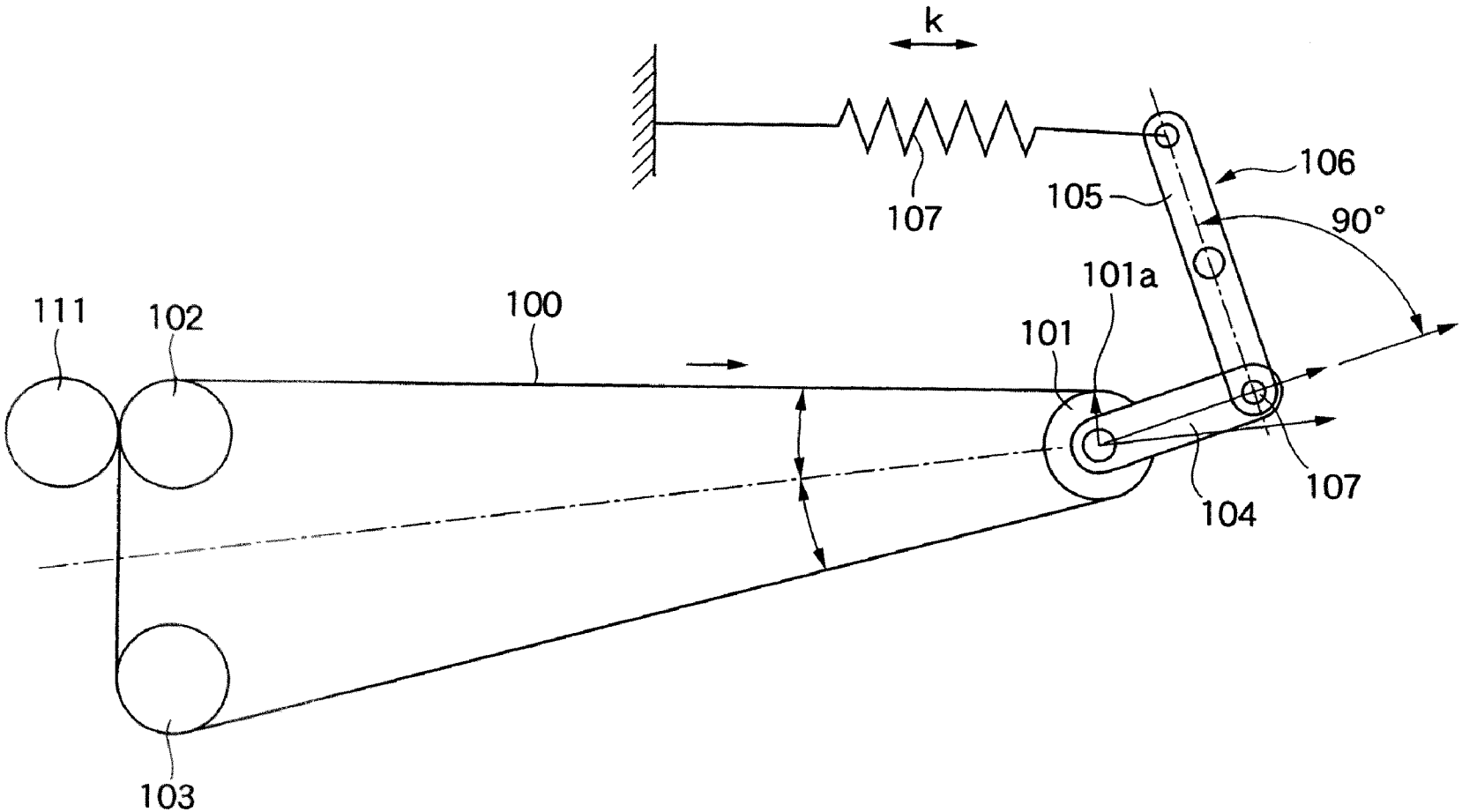
FIG. 20 is a front configuration diagram showing a belt meandering correction apparatus according to Embodiment 3 of the invention.

In the present Embodiment 3, as shown in FIG. 20, for example, the belt extending roll 101 located in one end part among the plurality of belt extending rolls 101 to 103 is adopted as a belt meandering correction roll. The one end part or the two end parts of the belt meandering correction roll 101 are supported by a link 106 having two arms 104 and 105 that are formed into an L-shape and that cross each other at an angle of 90 degrees. The link 106 is rotatable around a fulcrum 107. Further, the tip of one arm 105 of the link 106 is biased by a biasing unit 107 including a tension spring or the like having a spring constant k in the direction departing from another belt extending roll 102.

Then, the belt meandering correction roll 101 is supported by the biasing unit 107 via the link 106 in a manner movable in a direction defined by joining the revolving shaft center of the belt extending roll 101 to the point of contact with the endless-shaped belt member 100 extended around the belt extending roll 101. Accordingly, the fulcrum of the ink 106 is arranged on the extended line of the intermediate transfer belt 100. Thus, when the link 106 rotates around the fulcrum, the belt meandering correction roll 101, can move in the circumferential direction around the fulcrum 107, that is, in the direction defined by Joining the revolving shaft center of the belt extending roll 101 to the point 101*a* of contact with the intermediate transfer belt 100 extended around the belt extending roll 101.

Here, under the intermediate transfer belt 100, for example, image forming sections 110Y, 110M, 110C, and 110K for yellow (Y), magenta (M), cyan (C), and black (K) are arranged in parallel to each other. Then, toner images of individual colors consisting of yellow (Y), magenta (M), cyan (C), and black (K) formed by the image forming sections 110Y, 110M, 110C, and 110K are primary-transferred and stacked on to the intermediate transfer belt 100, and then secondary-transferred collectively onto a recording paper sheet (not shown) by a secondary transfer roll 111 abutting against the belt extending roll 102, so that a full color image is formed.

The other points in the configuration and the operation are similar to those of Embodiment 1 given above. Thus, their description is omitted.

What is claimed is:

1. A belt meandering correction apparatus comprising:

a plurality of belt extending rolls that extend an endless-shaped belt member, wherein at least one of the plurality of belt extending rolls is a belt meandering correction roll, and at least one end part of the belt meandering correction roll is supported in a manner movable in a direction defined by joining a center of a revolving shaft of the belt meandering correction roll to a point of contact with the endless-shaped belt member extended around the plurality of belt extending rolls so that meandering of the endless-shaped belt member is corrected;

a revolving body that is arranged at least at the one end part of the belt meandering correction roll in a manner movable along an axial direction of the belt meandering correction roll and that has a surface abutting against an end part of the endless-shaped belt member and an inclined surface whose outer diameter varies along the axial direction of the belt meandering correction roll; and a fixed member arranged at a fixed position such as to abut against an outer peripheral surface of the revolving body.

2. The belt meandering correction apparatus according to claim 1, wherein the revolving body revolves integrally with the belt meandering correction roll and moves integrally along the axial direction of the belt meandering correction roll.

3. The belt meandering correction apparatus according to claim 1, further comprising a holding member that holds the belt meandering correction roll in a revolvable manner, the holding member having a pressurizing unit that has a function of imparting a tension to the endless-shaped belt member and a function of correcting meandering of the endless-shaped belt.

4. The belt meandering correction apparatus according to claim 1, further comprising a biasing unit that biases the inclined surface of the revolving body in a direction abutting against the fixed member.

5. The belt meandering correction apparatus according to claim 3, wherein the holding member supports the belt meandering correction roll in a manner movable around the revolving shaft in the direction defined by joining the center of the revolving shaft of the belt meandering correction roll to a point of contact with the endless-shaped belt member extended around the belt meandering correction roll.

6. The belt meandering correction apparatus according to claim 3, wherein the holding member supports the belt meandering correction roll in a manner movable in two directions of: the direction defined by joining the center of the revolving shaft of the belt meandering correction roll to a point of contact with the endless-shaped belt member extended around the belt meandering correction roll; and the axial direction of the belt meandering correction roll.

7. The belt meandering correction apparatus according to claim 1, wherein the pressurizing unit includes a tension spring, and the belt meandering correction roll is held by the pressurizing unit and said fixed member.

8. An image forming apparatus comprising:

a paper conveyance belt in an endless-shaped that holds and conveys a recording medium;

a plurality of belt extending rolls that extends the paper conveyance belt, wherein at least one of the plurality of belt extending rolls is a belt meandering correction roll, and at least one end part of the belt meandering correction roll is supported in a manner movable in a direction defined by joining a center of a revolving shaft of the belt meandering correction roll to a point of contact with the paper conveyance belt extended around the belt meandering correction rolls so that meandering of the paper conveyance belt is corrected;

a revolving body that is arranged at least at said one end part of the belt meandering correction roll in a manner movable along an axial direction of the belt meandering correction roll and that has a surface abutting against an end part of said paper conveyance belt and an inclined surface whose outer diameter varies along the axial direction of the belt meandering correction roll; and a fixed member arranged at a fixed position such as to abut against an outer peripheral surface of the revolving body.

9. An image forming apparatus comprising:

a plurality of image forming sections that form toner images of mutually different colors;

an intermediate transfer belt in an endless-shape onto which the toner images are to be transferred;

a plurality of belt extending rolls that extending the intermediate transfer belt, wherein at least one of the plurality of belt extending rolls is a belt meandering correction roll, and at least one end part of the belt meandering correction roll is supported in a manner movable in a direction defined by joining a center of a revolving shaft of the belt meandering correction roll to a point of contact with the intermediate transfer belt extended around the belt meandering correction roll so that meandering of the intermediate transfer belt is corrected;

a revolving body that is arranged at least at the one end part of the belt meandering correction roll in a manner movable along an axial direction of the belt meandering correction roll and that has a surface abutting against an end part of the intermediate transfer belt and an inclined surface whose outer diameter varies along the axial direction of the belt meandering correction roll; and a fixed member arranged at a fixed position such as to abut against the outer peripheral surface of the revolving body.

* * * * *